US006207930B1

(12) United States Patent
Diesner

(10) Patent No.: US 6,207,930 B1
(45) Date of Patent: Mar. 27, 2001

(54) DEVICE FOR SEPARATING A MELTABLE WIDE STRIP INTO AT LEAST TWO STRIPS, ESPECIALLY PATTERNED STRIPS OF LABELS

(75) Inventor: Willi Diesner, Murg (DE)

(73) Assignee: Vaupel Textilmaschinen GmbH & Co. KG, Wuppertal (DE)

( * ) Notice: Subject to any disclaimer, the term of this patent is extended or adjusted under 35 U.S.C. 154(b) by 0 days.

(21) Appl. No.: 09/284,931

(22) PCT Filed: Oct. 17, 1997

(86) PCT No.: PCT/EP97/05737

§ 371 Date: Apr. 23, 1999

§ 102(e) Date: Apr. 23, 1999

(87) PCT Pub. No.: WO98/18995

PCT Pub. Date: May 7, 1998

(30) Foreign Application Priority Data

Oct. 26, 1996 (DE) ..... 196 44 534

(51) Int. Cl.[7] ..... F27D 11/00

(52) U.S. Cl. ..... 219/388; 156/251; 156/267; 83/170; 83/15

(58) Field of Search ..... 219/388, 221; 83/15, 16, 170, 171; 156/251, 259, 267, 271, 515, 522; 26/7, 10.4, 15 R, 17

(56) References Cited

U.S. PATENT DOCUMENTS 4,069,727 * 1/1978 Sparks et al. ..... 83/16
4,384,908 * 5/1983 Kleist ..... 156/88
5,101,094 * 3/1992 Keller et al. ..... 219/221
5,115,839 * 5/1992 Speich ..... 139/291 C

FOREIGN PATENT DOCUMENTS 678953 11/1991 (CH) .
2300686 7/1974 (DE) .
2516057 10/1976 (DE) .
9302246 2/1993 (WO) .
9713023 4/1997 (WO) .

* cited by examiner

*Primary Examiner*—Teresa Walberg
*Assistant Examiner*—Shawntina T. Fuqua
(74) *Attorney, Agent, or Firm*—Friedrich Kueffner

(57) ABSTRACT

A device for separating a meltable wide strip (10) using fusion cutters (21) which cut the strips (10') during longitudinal movement of said wide strip by melting the strip material. In order to smooth rough melted edges of strips (10') a finishing device is used. A conveyor device is used to transport the wide strip and keeps at least the section (40) to be processed of the strip (10') which is located in the finishing zone, under longitudinal stress. To simplify the design of the device, the finishing device is provided with deviation points (71, 70, 72) in the section (40) to be processed. The deviation points are fixed and include an open slit (25) through which the section (40) to be processed passes. The expansion of the processing section (40) is twisted by virtue of the deviating members (23, 33). The longitudinal stress is therefore exerted in such a way that the upper and lower side of the strips (10') are automatically pressed against the deviating members (23, 33). This results in an ideal smoothing of rough melted edges.

19 Claims, 6 Drawing Sheets

FIG. 2
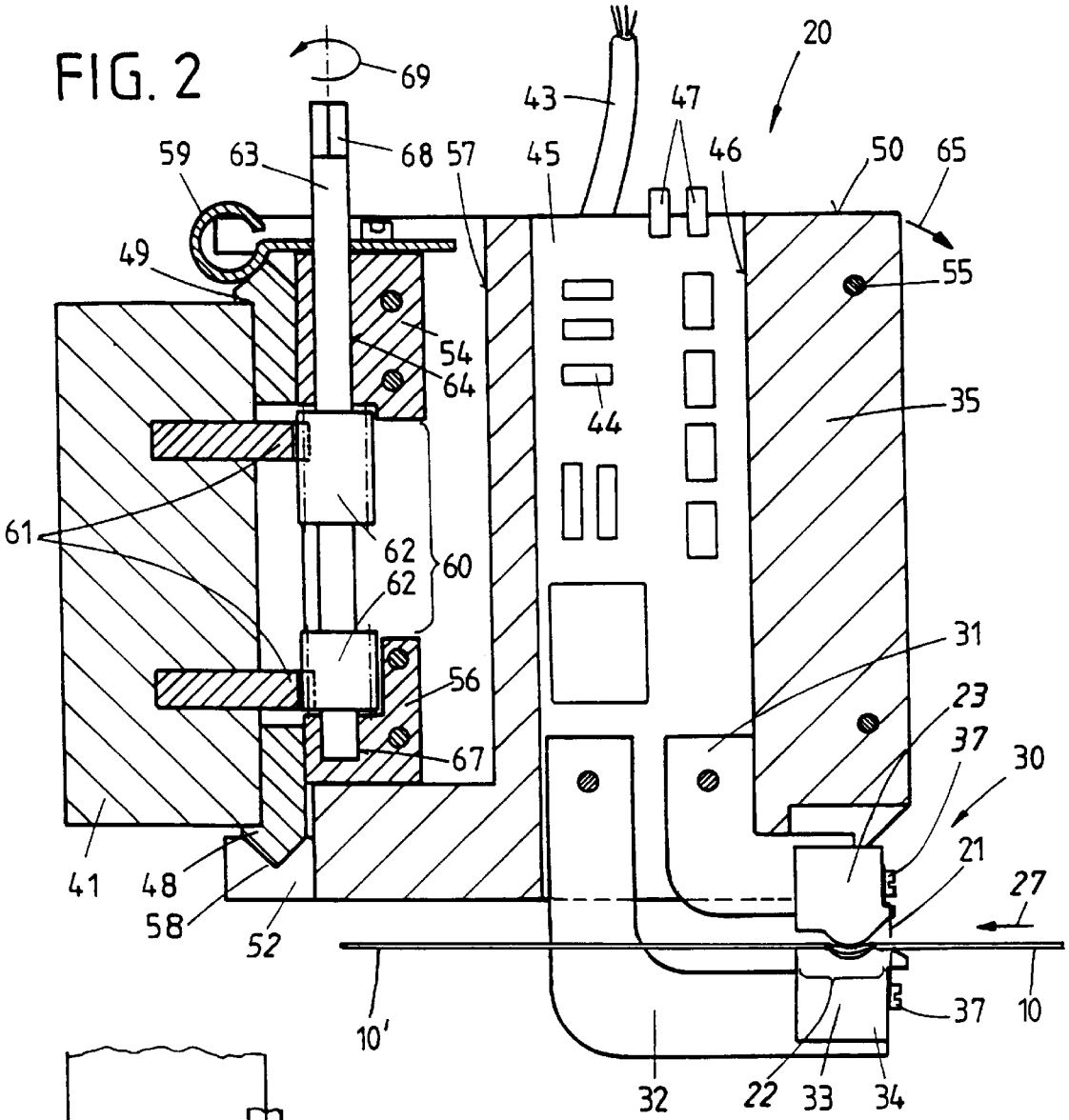
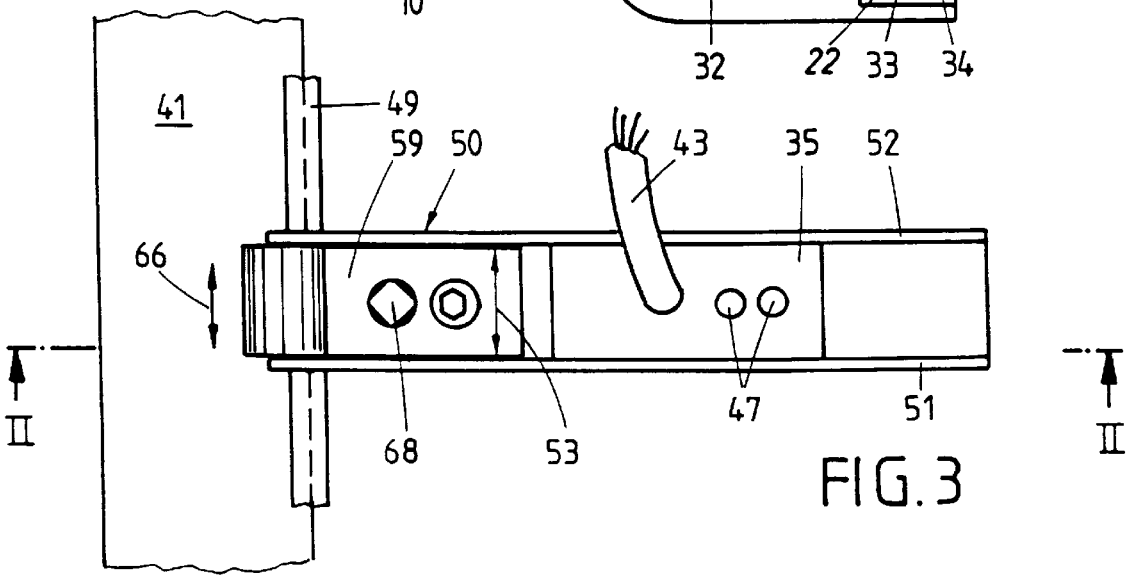
FIG. 3

DEVICE FOR SEPARATING A MELTABLE WIDE STRIP INTO AT LEAST TWO STRIPS, ESPECIALLY PATTERNED STRIPS OF LABELS

The invention pertains to a device of the type indicated in the introductory clause of Claim 1.

To produce strips of labels, a weaving machine is first used to produce a wide web, which is made up of several rows of labels side by side in adjacent zones of the web, these rows being attached to each other along their edges. Then the wide web is cut along the boundaries between the individual zones by fusion cutters to produce separate tapes. For this purpose, a heated wire, for example, can be permanently mounted in the path of the wide web to cut the web by melting it through. This wire simultaneously fuses the cut ends of the threads together, so that they cannot fray out. Fused edges are thus formed on the tapes. These fused edges are relatively hard, and, unless they are given a finishing treatment, they have a rough profile. If the unfinished labels are attached to articles of clothing, the rough edges of the tapes produce an unpleasant feeling when the article is worn.

To eliminate the rough, fused edges of the tapes, a finishing device is used to smooth their edges. In the known device of the type cited in the introductory clause of Claim 1 (WO 93/02,246), two rolls are used to finish the rough edges of the tapes; these rolls are pressed together as the cut tapes are pulled between them. A wire is used as the fusion cutter. Simply because of the diameter of the knife roll, this finishing device must be installed a considerable distance away from the heating wire. The fused edges of the tapes coming from the heating wire harden on their way to the rolls. Therefore, it is necessary to heat the rolls by means of an independent heat source. In addition, springs are required to press the two rolls against the fused edges. In the case of tapes consisting of rows of patterned labels, the thickness of the tape can differ considerably from one region to another. This known device occupies a relatively large amount of space and is expensive.

In another known device of this type (GB-A 2,139,947), a heated pad is used for finishing. This pad is pressed by a spring-loaded piston against the fused edges of the tapes to be treated. This device also occupies a relatively large amount of space.

In a known device of a different type, which does not provide for any finishing of the rough, fused edges (DD-A 38,545), comb-like elements fitting between adjacent tapes are used to prevent the cut edges from sticking to each other. This effect is supported by fingers, which act on the central zone of the cut tapes and deflect adjacent tapes in alternate directions, one up and the other down. These fingers are not allowed to touch the edge areas, because this would prevent adjacent tapes from spreading as desired.

In a resistance-heated cutting device for textile webs, which again does not offer any means of finishing the rough edges of the tapes (DE-C1 195-10, 818), the tape is simply sent straight through. The housing holding the heated wire is located in the gap between the fused edges of adjacent tapes.

The invention is based on the task of developing the simplest possible, trouble-free finishing device of the general type described in the introductory clause of Claim 1, which is designed in such a way that it saves space and can be produced inexpensively. This goal is accomplished according to the invention by means of the features given in claim 1, which have the following specific meaning:

As a finishing device, the invention uses at least two deflection points, which are offset with respect to the tapes both in the longitudinal direction and also in the vertical direction. These points act on the section of the tape to be processed. For this purpose, deflecting elements are provided at the edges of the tapes; these elements do not require any springs or guides to press them together. The invention provides a free space between the deflecting elements, through which the section of the tape to be processed passes without being held but nevertheless in such a way that the deflecting elements cause the edges of the tape to extend slightly at an angle out of a straight course. The vertical offset of the deflecting elements in the edge area does not need to be more than a few millimeters.

The invention has recognized that, as a result of this deflection of the section of the tape to be processed, the longitudinal tension serving to transport the wide web and the tapes into which it is cut can be used to apply the pressure to which the edge areas must be subjected. That is, this deflection has the effect of converting some of the tension acting in the longitudinal direction of the tape into a transversely directed force component, and this transverse force is able to generate the required pressure. The longitudinal tension required in any case to transport the wide web and the tapes thus acquires the new function of ensuring the smoothing of the cut edges of the tapes. The transport device used to produce the longitudinal tension cooperates in the finishing of the fused edges.

It is advantageous to provide at least two, preferably three, deflection points, against which, in sequence, first the edge areas of the top side and then the edge areas of the bottom side are pulled. As a result, the fused edges are smoothed, and tapes with ideally smooth, soft edges are obtained. This design is very simple, compact, and inexpensive. There is no need in the device according to the invention for any springs or guides for pressure-exerting components such as those required in the known finishing devices.

Additional measures and advantages of the invention can be derived from the subclaims, from the description below, and from the drawings, which illustrate several exemplary embodiments of the invention:

FIG. 2 shows, on an enlarged scale, a cross-sectional side view along line II—II of FIG. 3 of a compact device according to the invention, provided with both the fusion cutter and the finishing device;

FIG. 3 shows a plan view of the device shown in FIG. 2;

Figure 6:
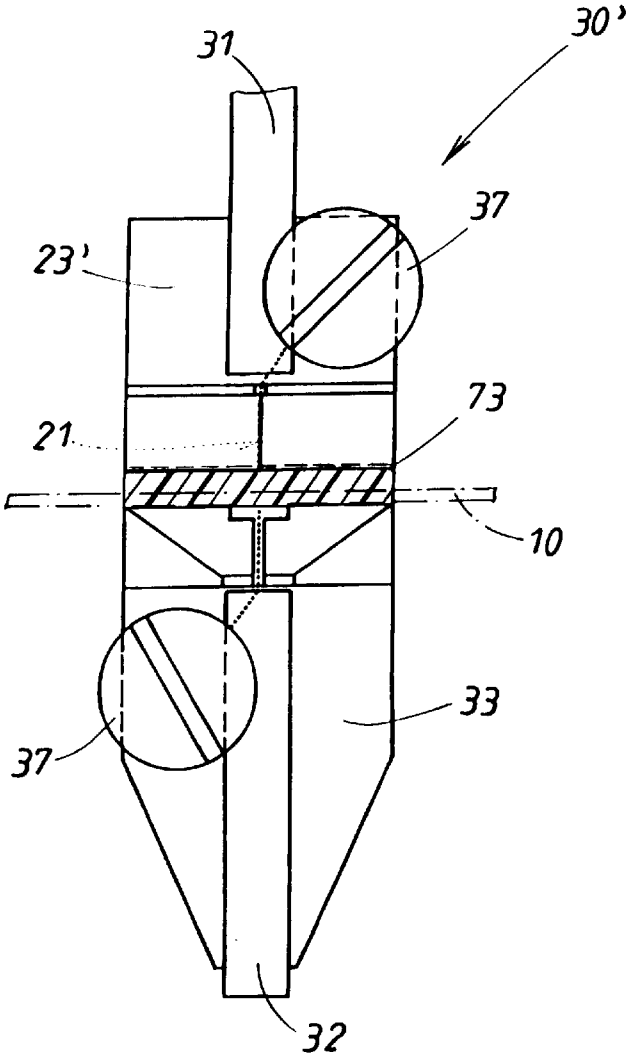
FIG. 6 shows a front view of the device according to FIG. 5, looking the direction of arrow VI.
Figure 5:
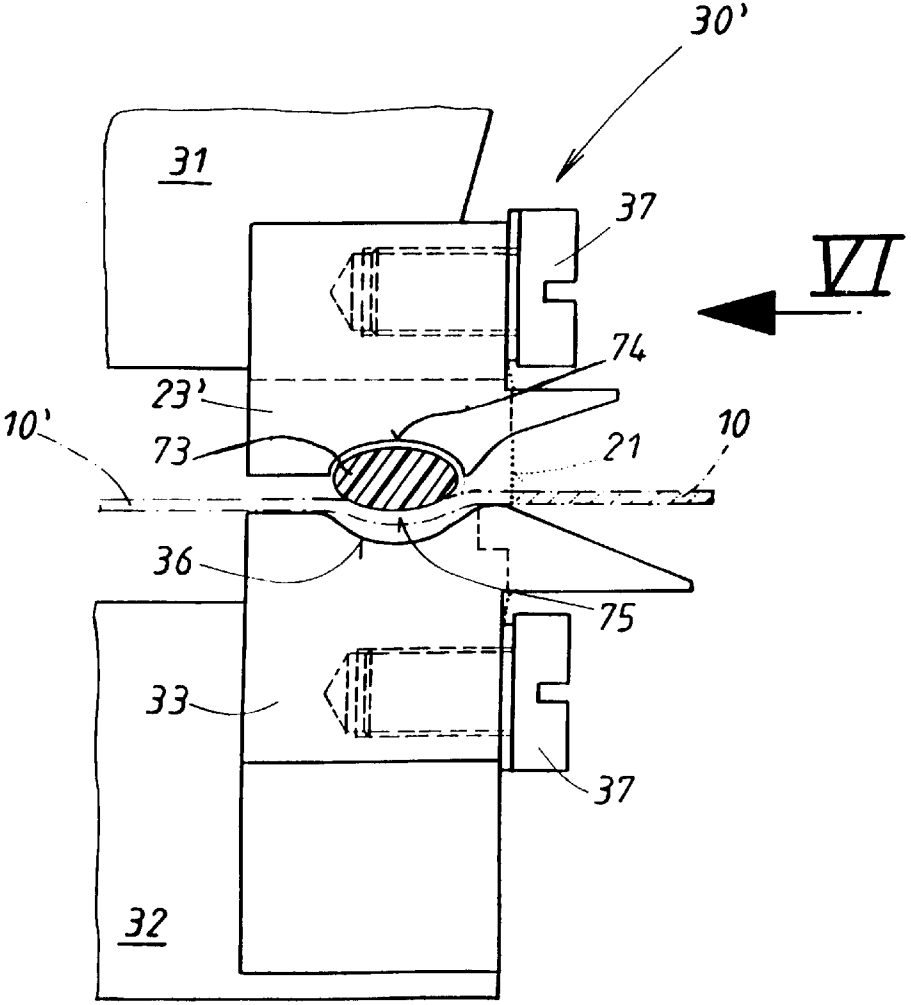
FIG. 5 shows, on the basis of a detail of FIG. 4, an alternative design of the device according to the invention.
Figure 8:
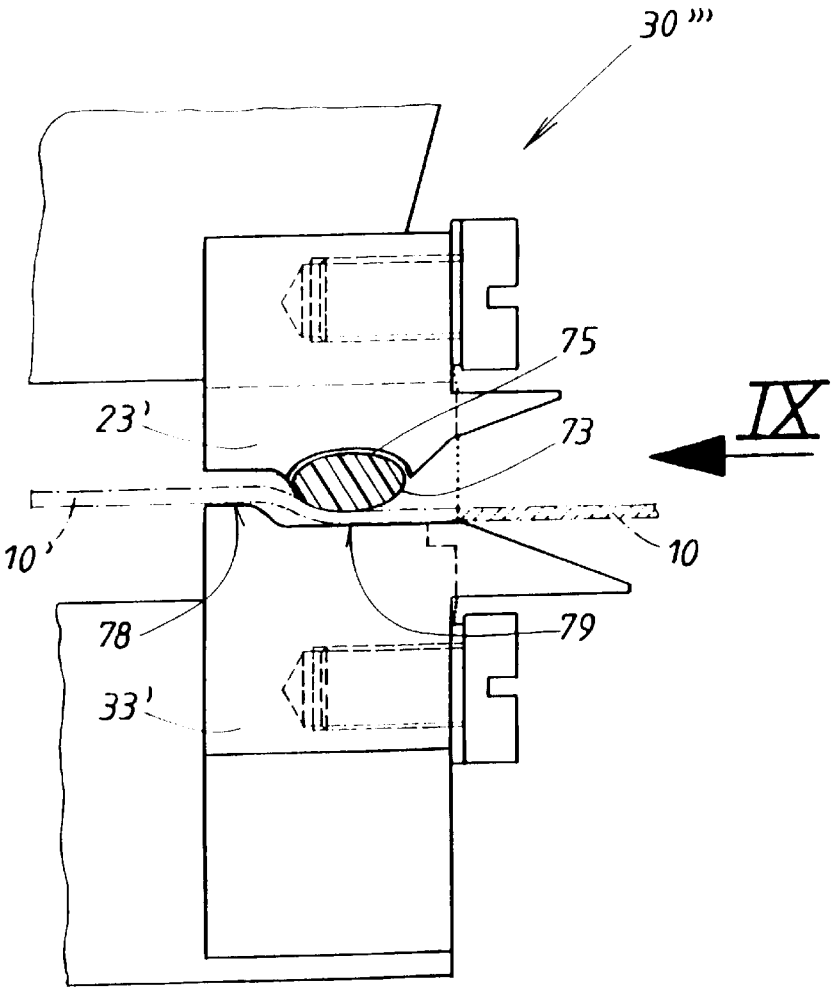
Figure 7:
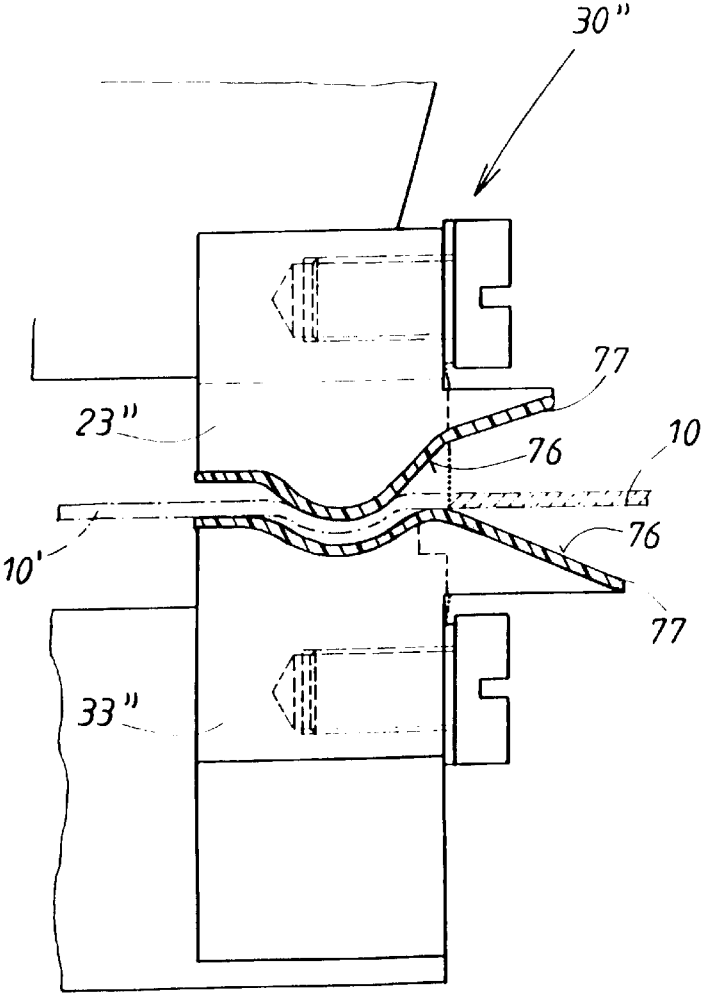
Figure 9:
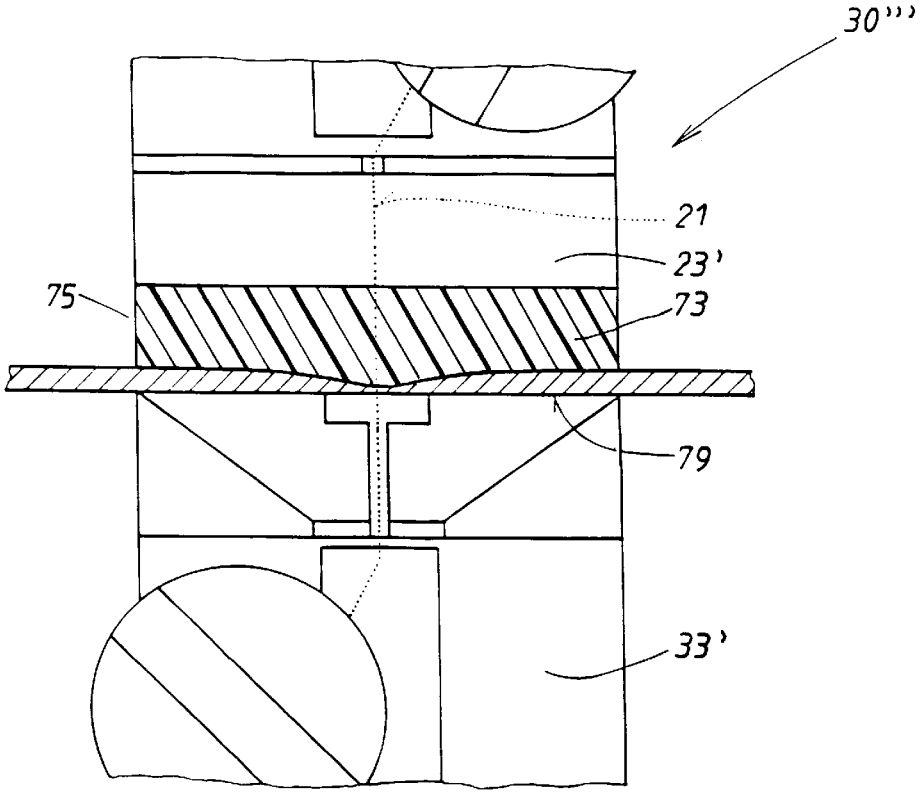
Figure 10:
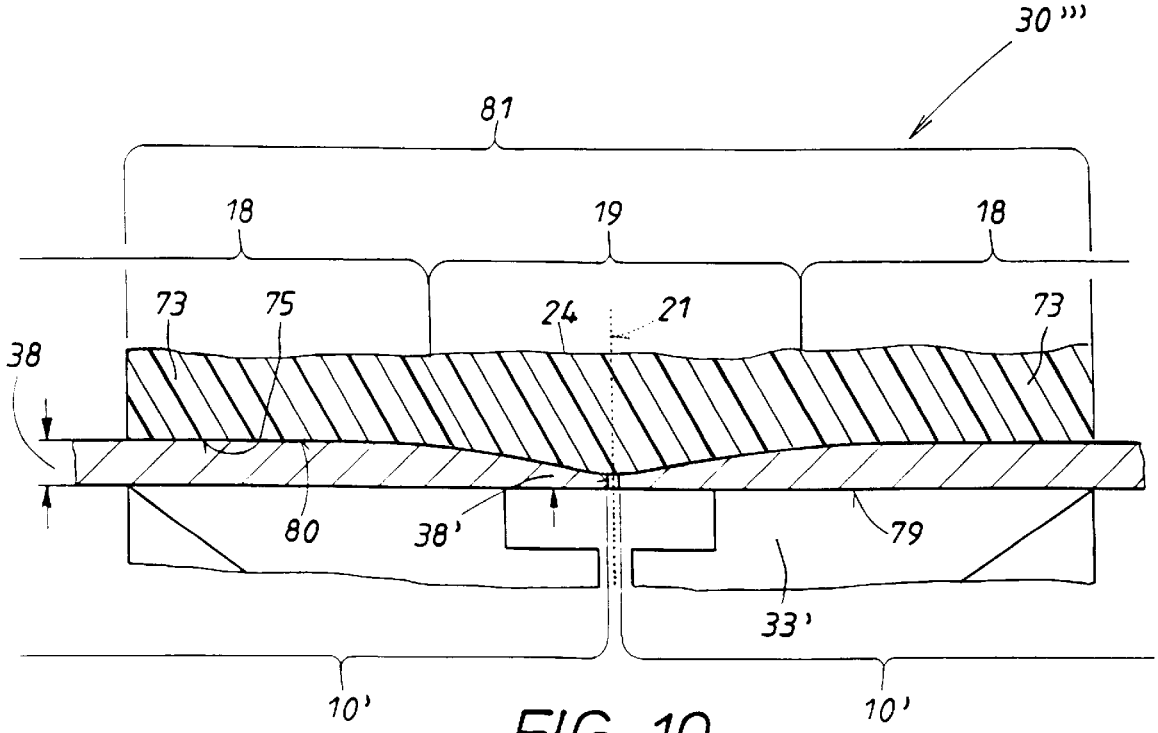

FIGS. 7 and 8, in the form of diagrams corresponding to FIG. 5, show two additional alternative designs of the device;

FIG. 9, in the form of a diagram similar to FIG. 6 but on a larger scale, shows a front view of the device shown in FIG. 8; and FIG. 10 shows a part of the front view shown in FIG. 9 on an even larger scale.

Figure 1:
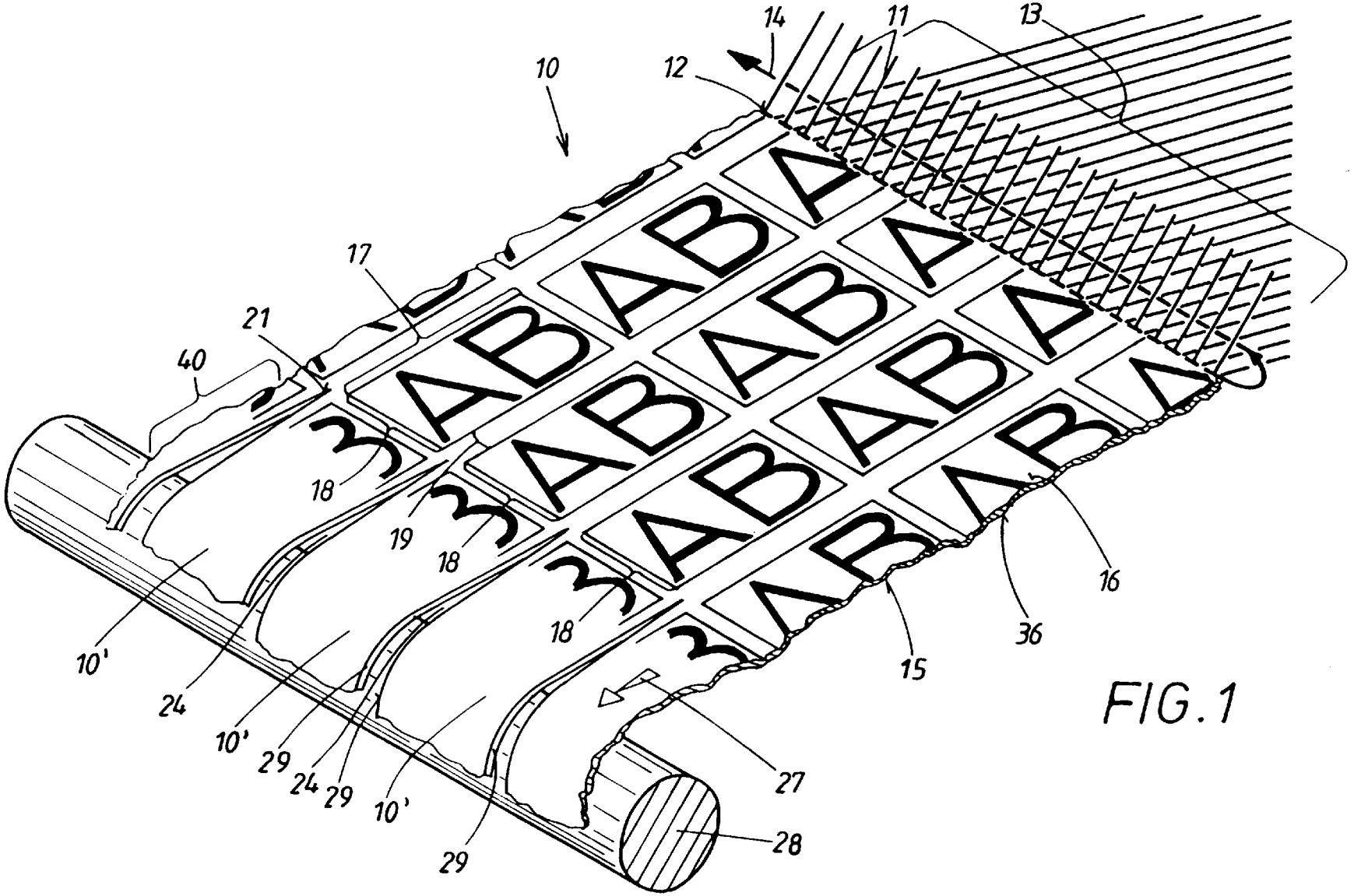
FIG. 1 shows a schematic diagram, in perspective, of various steps of the work process, including in particular the production of the woven fabric, forming the wide web, which is to be cut into tapes. For the sake of clarity, both the fusion cutter and the finishing device have been omitted.
Figure 4:
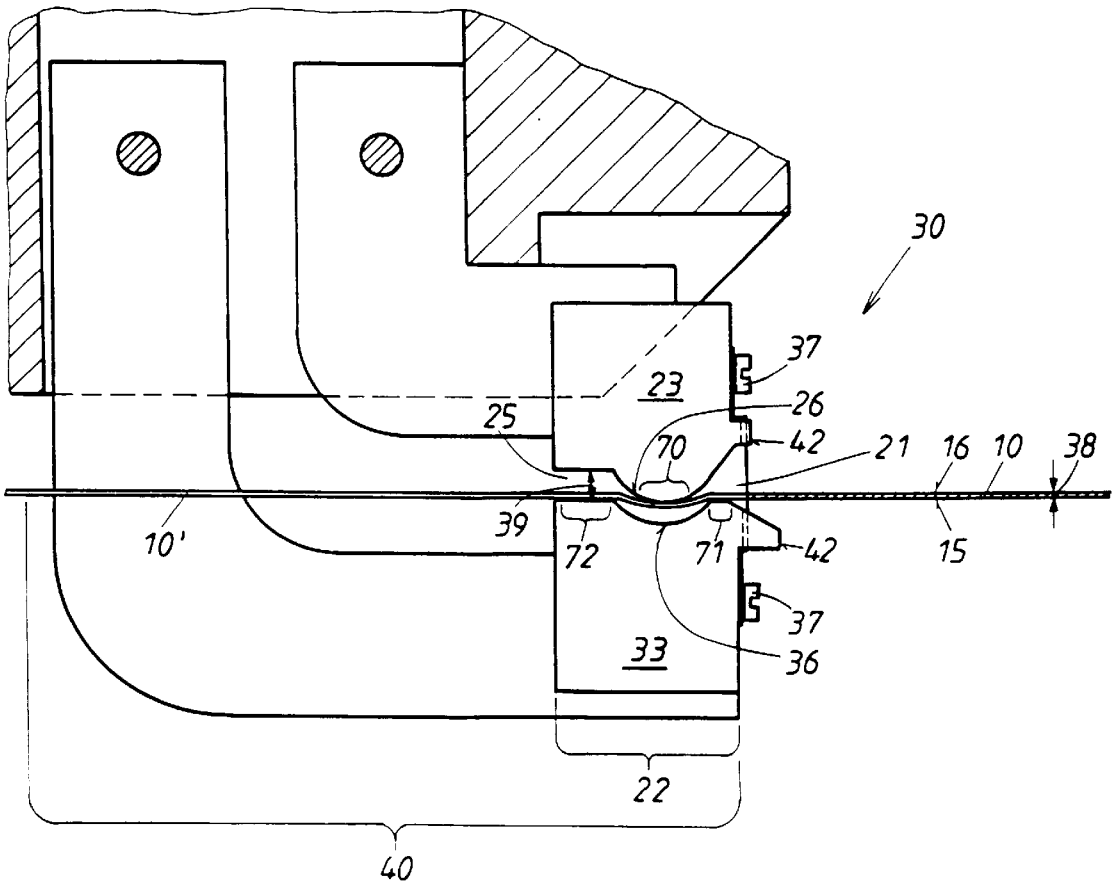
FIG. 4 shows a diagram, corresponding to FIG. 2, of a detail of the device on an even larger scale.

FIG. 1 shows a weaving machine, on which a wide web 10 is produced as a piece of woven fabric. Several arrangements of the device according to the invention, shown in FIGS. 2–4, are integrated into this wide web 10. It is obvious that other types of textile machines, e.g., knitting machines, can also be used, in which case knitted material would be produced in a similar manner. A foil, a nonwoven, or any other type of sheet material could be used as wide web 10 as long as it is fusible. In FIG. 1, the woven fabric of wide web 10 is produced at the weaving site, indicated in schematic fashion by the number 12, by the crossing of warp threads 11 with several woof threads 14, which extend across the entire width 13 of the web. During weaving, various patterns 17 are produced; in this case, they could be on top side 16 or on bottom side 15. These patterns repeat in the longitudinal direction and are situated on adjacent zones 18 of the web.

The devices 20 according to the invention, which are described in greater detail on the basis of FIGS. 2–4, are located at longitudinal strips 19 of FIG. 1, which are between tape zones 18. Each of these devices consists of a combination of a fusion cutter 21 and a special finishing device 22; these have been omitted in FIG. 1. Separating cuts 24 in wide web 10 are produced by the fusion cutter, the position of which is indicated by the number 21 in FIG. 1, as a result of which wide web 10 is divided into several tapes 10'. This in effect is achieved as a result of the longitudinal motion of wide web 10 in the direction of arrow 27. For this purpose, a transport device is used, a take-off roll 28 of which is shown in FIG. 1. The rotational speed of take-off roll 28 of the transport device determines the density of woof threads 12 in the fabric.

The transport device not only moves wide web 10 and thus tapes 10' cut from it in the longitudinal direction 27 but also keeps them under a certain longitudinal tension. This longitudinal tension, however, is required for the weaving process itself. Warp threads 11 must be kept under a standard thread tension. By means of separating cut 24 by each of the various fusion cutters 21, fused edges 29 are formed along the longitudinal edges between adjacent tapes 10'. These are still rough in the area of fusion cutter 21, but they are smoothed in the following, previously mentioned finishing device 22, which is located at the section of the tape to be processed, as indicated in FIG. 1 by the number 40. This processing section 40 of the tape is also under the same longitudinal tension as wide web 10 and tapes 10'. This longitudinal tension is especially high just before take-off roll 28 but lower behind it. Finishing device 22 can be installed either before or after the take-off roll.

As FIGS. 2–4 show, the fusion cutter is an electrically heated wire 21, which passes through wide web 10 from top side 16 to bottom side 15. This wire 21 is a component of device 20 according to the invention, to which also two deflecting elements 23, 33 belong. The two deflecting elements 23, 33, are fixed in permanent positions in device 20 and enclose between them an open gap 25, which is shaped and which serves to deflect web 10. A device 20 of this type is provided at each point of wide web 10 where the mentioned separating cuts 24 are to be produced. These numerous devices 20 are mounted on a continuous supporting beam 41, omitted from FIG. 1 but shown in FIGS. 2 and 33 it extends transversely across wide web 10. The two deflecting elements 23, 33 consist of metal blocks. These blocks extend essentially over only the area where a pair of fused edges 29 are produced in adjacent tapes 10' by the associated wire 21.

Gap surfaces 26, 36 of the two deflecting elements 23, 33 producing gap 25 have different profiles. In the present case, gap surface 26 is convex, whereas the other gap surface 36 is concave. Width 39 of the gap, which can be seen in FIG. 4, can be much greater than thickness 38 of the fabric; as a result, gap surfaces 26, 36 on the two sides come into contact with different zones of top and bottom sides 16, 15 of cut tapes 10'. Crest area 70 of convex gap surface 26 comes into contact with top side 16 of the web, whereas support zones 71, 72 of opposing support surface 36, located ahead of and behind the crest, come into contact with bottom side 15 in two different areas which are offset from each other in the lengthwise direction. Support zones 71, 72 enclose the concave recess of gap surface 36; there is no contact with bottom side 15 of the web in this concave recess. The top side contact area 70 is not aligned with the bottom-side contact areas 71, 72 but rather always offset from them in the longitudinal direction. In addition, the top-side support in crest area 70 is lower down in the vertical direction than the front and back support zones 71, 72 of bottom web side 15. In this area, therefore, section 40 of the tape to be processed is deflected from the straight-through course which would normally have been produced by the longitudinal tension. This is of crucial importance.

As a result of this deflection, force components which serve automatically to press top side 16 against deflection point 70 and bottom side 15 against support zones 71, 72 are generated out of the longitudinal tension acting in the section to be processed; as a result, the rough, fused edges are smoothed. Support zones 71, 72 can be straight and can follow the straight-through course of tape section 40. It is obvious that, if needed, several such deflection points 70–72 and/or several deflecting elements 23, 33 can be provided. The effective pulling force can be increased by offsetting deflecting point 70 on one side even more from areas 71, 72 on the other side. In the case of a label tape with a woven thickness 38 of a few tenths of a mm, a gap width 39 of about 1 mm is sufficient. Changes in fabric thickness 38 in the longitudinal course of label tape 10 do not matter. A vertical offset between top deflecting point 70 and bottom deflecting areas 71, 72 of about 0.15 mm is sufficient.

Deflecting elements 23, 33 are unheated, but they are so close to fusion cutter 21 that edge areas 29 of tapes 10' are still plastic. As already mentioned, the fusion cutter consists in the present case of a heated wire 21, the ends of which are attached to the two deflecting elements 23, 33. These deflecting elements 23, 33 are made of metal and serve at the same time as conductors for supplying heating current to wire 21. The lengthwise distance between heating wire 21 and first deflecting area 71 is less than 1 mm. Thread material 11, 14 of the wide web can melt at a temperature in a range as low as 160–200° C. Heating wire 21 is heated to a dark red glow and therefore reaches a temperature of more than 400° C. Deflecting elements 23, 33 have here the form of blocks, are made of brass, and are therefore good heat conductors. Heat is therefore transferred from heated heating wire 21 to the two blocks 23, 33, and the temperature of the heating wire thus can drop indirectly to a temperature of about 70° C. Device 22, used to finish the two fused edges of adjacent tapes 10' formed by heating wire 21, is combined with wire 21 to form a compact assembly 30.

This assembly 30 is a component of a block 35, which has the form of a plate, consists of insulating material, and is itself a component of a housing 50. Two electrical connectors 31, 32 project from the bottom end of block 35. In the present case, these connectors have the form of angled pieces of sheet metal, one of which 31 terminates above, the other 32, below wide web 10. Lower piece 32 carries deflecting element 33, which, as already stated, has the form of a block, but which in the present case has a wedge-shaped cross-sectional profile. The pointed tip 34 of the wedge of support element 33 points downward to facilitate the installation of block 35 on wide web 10 from the top side of the web. At the front end surface of wedge-shaped deflecting element 33, there is a fastener 37 for the lower end of wire 21. Upper piece 31 of sheet metal is provided at the end with the upper, block-like deflecting element 23, which also has a fastener 37 for the other end of wire 21. To secure the position of wire 21, guide projections 42 are provided on the front end surface of the two deflecting elements 33, 23.

At the upper end of block 35, an electric cable 43 extends to the outside. This cable carries the electric supply lines for the heating current needed for wire 21; although these lines cannot be seen in detail, they are in electrical contact with the previously mentioned, angle-shaped pieces of sheet metal 31, 32. Electric cable 43 can also contain electric control lines. The electric lines of cable 43 are contacted by electrical components 44, which are located inside block 35 and which are used to control the heating of wire 21. Electrical components 44 are advisably a component of an electrical printed-circuit board 45, which is integrated into the interior of block 35. For this purpose, printed-circuit board 45 can be cast in a plastic composition together with components 44 and the inward-projecting end of cable 43 into a channel 46 in block 35. Function indicators 47, which project out of block 35 and which display, for example, the thermal operating state of wire 21, can also be mounted on printed-circuit board 45. Function indicators 47 consist in the present case of a red and a green glow lamp.

As already mentioned, block 35 is a component of a housing 50, which consists in the present case simply of two flat side plates 51, 52, the distance 53 between which is determined simply by the thickness of block 35 lying between them. Block 35 is sandwiched between the two side plates 51, 52 and held by fastening screws, which pass through holes 55 in block 35 and are anchored at both ends in side plates 51, 52.

Housing 50 is attached to the previously mentioned supporting beam 41, which consists here of a mounting rail 41, extending transversely across the fabric. To hold housing 50, mounting rail 41 has an upper and a lower shaped strip 48, 49. Lower shaped strip 48 has an edge cross section which serves to guide housing 50 along mounting rail 41 and engages in a corresponding angled notch 58 at the back of the two housing side plates 51, 52. As part of the attachment operation, a catch spring 59, which functions as a holding means for housing 50, grips behind shaped strip 49 of mounting rail 41. Catch spring 59, as FIG. 3 shows, is located in space 53 between the two side plates 51, 52, and sits on an insert 54, which is attached in turn between the two plates 51, 52 by screws passing through holes. Insert 54 also rests with a guiding action against the front end surface of upper shaped strip 49. Insert 54 is also sandwiched between the two side plates 51, 52, for which purpose plate-shaped block 35 has a step-like open space 57 at the end facing mounting rail 41.

As part of the attachment operation, as FIG. 2 shows, catch spring 59 grips behind a rear edge of upper shaped strip 49 and holds housing 50 under elastic tension in a positive, form-locking manner against mounting rail 41. In open space 57 of plate-shaped block 35, there is also another insert 56, which, during the assembly operation, exerts a guide function on the forward end surface of lower profile guide 48. This insert 56, too, is provided with holes for fastening screws, which hold insert 56 in a sandwich-like manner between the two side plates 51, 52. Catch spring 59 can be pried by a tool, e.g., a screwdriver, out of its engaged position shown in FIG. 2, in which it grips behind upper shaped strip 49. Housing 50 can then be tipped away in the direction of pivot arrow 65 from mounting rail 41 thus readily removed from mounting rail 41. The center of rotation for this pivoting motion 65 is thus in the area where previously described notch 58 in the plate latches to lower shaped strip 48. After housing 50 has been swung out of the way 65, it can be pulled off lower shaped strip 48 and thus conveniently removed from mounting rail 41. The installation of housing 50 on mounting rail proceeds in the reverse sequence.

In the invention, adjusting means 60 are also provided on housing 50; these adjusting means allow a lengthwise adjustment to be made in the direction of double arrow 66 along mounting rail 41 as shown in FIG. 3. This is necessary to set the cutters to the exact width to which tapes 10' are to be cut. These adjusting means 60 comprise pinions 62, which engage with toothed racks 61 on mounting rail 41. Toothed racks 61 are provided on the face of mounting rail 41 between the two indicated shaped strips 48, 49. Adjusting means 60 on the housing side are located in space 53 between the two side plates 51, 52 and are lodged in opening 57, already mentioned several times, in block 35 between the plates. Pinions 62 are mounted on a shaft 63, the operating end 68 of which projects out at the top end of housing 60; the shaft is supported with freedom of rotation in an upper and a lower bearing 64, 67, which are located in the above-mentioned inserts 54, 56. By means of a turning tool, shaft 63 can be rotated in the direction of operating arrow 69 of FIG. 2, as a result of which housing 50 is adjusted in the lengthwise direction 66 on mounting rail 41.

To smooth the fabric after weaving, a heat treatment is applied, which is referred to as "thermofixing". The best place for this thermofixing is in the area of take-off roll 28.

Devices 20 according to the invention do not need to be integrated into a loom according to FIG. 1. In place of this "on-loom" design, the device could also be a component of a cutting table, where a wide web 10 previously produced on a loom or a knitting machine is then cut afterwards into individual tapes 10'. In this case, an "off-loom" design is used.

FIGS. 5 and 6 show a side view, similar to that of FIG. 4, and a front view, illustrated by arrow VI in FIG. 5, of a modified design of the device according to the invention, which represents a similar assembly 30', for which reason it is sufficient merely to point out the differences.

In the case of the exemplary embodiment according to FIGS. 2–4 of assembly 30, deflecting elements 23, 33, as already mentioned above, are designed as metal blocks and are therefore dimensionally stable. Previously described deflecting surface 70 of FIG. 4 therefore does not give way under the pressure of wide web 10. In the case of assembly 30' of FIGS. 5 and 6, similar blocks are used as deflecting elements 23', 33, but one of the deflecting elements 23' has a recess 74, in which an insert 73 of elastic material is located. Whereas blocks 23', 33 are of brass, insert 73 is made of silicone. Some other non-rigid material such as a temperature-resistant foam or the like could also be used. Because of its compliant property, insert 73 could also be referred to as a "cushion", the outside surface of which produces an elastic guide surface 75 for tapes 10' of wide web 10 indicated there in dash-dot line.

In a detail view corresponding to FIG. 5, FIG. 7 shows another alternative of the device according to the invention on the basis of a modified assembly 30". The difference in comparison to assembly 30 of the first exemplary embodiment is that the two metal deflecting elements 23", 33", which are in the form of block-like pieces in this case, too, are provided with a pliable coating 77 on the surfaces 76 which come in contact with the tapes. This coating also consists of silicone or of some other elastic or heat-resistant material.

FIG. 8 shows a third exemplary embodiment of the device according to the invention on the basis of an assembly 30''', which is largely the same as the first alternative of FIGS. 5 and 6 described above, but which has been modified in the sense that the concave area in the lower deflecting element as found in assembly 30 is missing. In the case of assembly 30''', a step is present on lower deflecting element 33'; this step produces a deflecting point for tape 10' only at rear, elevated step surface 78. As a result of this deflection, the bottom surface of tape 10' is pulled up at 78, whereas the top surface, as already explained in conjunction with the exemplary embodiment according to FIG. 5, is pulled down to the flexible deflecting surface of cushion 73. In a further modification of this exemplary embodiment of FIG. 8, flexible cushion surface 75 could pull tape 10' against a forward step surface 79 and thus bring about the smoothing of the edge areas on the bottom surface of the tape even at this early point. If the smoothing there is sufficient, then rear elevated step surface 78 could be omitted.

One of the reasons why flexible deflecting surfaces 75 are made of elastic material with poor thermal conductivity is that the still-plastic edge areas of tapes 10' coming from heated wire 21 are thus prevented, at least at deflecting element 23' or 23", from giving up their heat to the metal components in this area. When the device according to the invention is used on a loom, where cut tapes 10' are transported slowly and some time is required for the cut edge areas to arrive at deflecting surface 75, the thermal insulation of such cushions 73 or coatings 77 is important. The deflecting points are then able to act on the plastic edge areas while they are still sufficiently plastic and thus produce an optimum smoothing effect. This thermal insulation is especially effective when contact surfaces 77 are provided with such coatings 77 on all their contact surfaces 76, as provided in the third exemplary embodiment 30''' of FIG. 7.

Another reason why the flexible deflecting surfaces are important is explained in FIGS. 9 and 10. The way in which a flexible cushion 73 works is illustrated here on the basis of a fourth exemplary embodiment of assembly 30'''. As can be seen especially clearly in FIG. 10, the two separated tapes 10' of the original wide web, produced by separating cut 24 made by heating wire 21, have areas of different thickness 38, 38'. According to FIG. 1, in the case of label tapes, patterns 17 are produced only in certain zones 18 of the web, these zones being separated from each other by longitudinal strips 19 without any pattern. Patterns 17 in middle zones 18 require additional pattern threads, for which reason an especially thick fabric 38 is obtained in these zones, whereas thickness 38' of the tape is much less in longitudinal strips 19 between the pattern zones. This thickness can also vary in the widthwise direction of longitudinal strips 19 themselves, as FIG. 10 illustrates. As a result, the irregular tape profile 80 which can be seen on tapes 10' in FIG. 10, for example, is created.

Because now at least the one deflecting surface 75 of upper deflecting element 23' is an elastically flexible cushion surface 75, a cushion shape 81 which corresponds automatically to tape profile 80 is obtained on cushion 73. Full-surface contact therefore occurs in the edge areas, because cushion shape 81 automatically adjusts itself to the given tape profile 80. The edges of tapes 10' are therefore smoothed very effectively, which leads to soft edges.

The adaptation of elastically flexible outside surface 75 of deflecting element 23' has been explained in FIG. 10 on the basis of transverse strip profile 80, present crosswise to transport direction 27 of FIG. 1, but this explanation also applies in analogous fashion to a longitudinal shape of tapes 10' in their transport direction 27, which can be present at least in the case of labels. That is, patterns 17 within a tape 10' are also separated by pattern-free zones from one another, as shown in FIG. 1, and thus the tape can again be thinner in these areas. This is especially true when, to form the pattern, a so-called "figure woof" is used, which is absent in the transition zones between patterns 17. The previously mentioned adaptation of cushion shape 81 also occurs when there is a change in the thickness of the tape in the transport direction. Cushion shape 81 conforms to the irregular longitudinal shape of the tape between the individual patterned labels.

List of Reference Numbers

| | |
|---|---|
| 10 | wide web |
| 10' | tape |
| 11 | warp thread |
| 12 | weaving site |
| 13 | width of web |
| 14 | woof thread |
| 15 | bottom side of 10 and 10' |
| 16 | top side of 10 and 10' |
| 17 | pattern |
| 18 | tape zone |
| 19 | longitudinal strip |
| 20 | device |
| 21 | fusion cutter, wire |
| 22 | finishing device |
| 23, 23', 23" | upper deflecting element (FIGS. 4, 5, 7) |
| 24 | separating cut |
| 25 | gap |
| 26 | convex gap surface |
| 27 | arrow of the longitudinal motion of 10, 10' |
| 28 | transport device, take-off roll |
| 29 | fused edge of 10' |
| 30, 30', 30" | assembly (FIGS. 4, 5, 7) |
| 30 ''' | assembly (FIGS. 8–10) |
| 31 | connection for 21, angle-shaped piece of sheet metal |
| 32 | connection for 21, angle-shaped piece of sheet metal |
| 33, 33', 33" | lower deflecting element |
| 34 | tip of wedge of 33 |
| 35 | plate-shaped block for 50 |
| 36 | concave gap surface, concave form |
| 37 | means for fastening 21 to 33, 23 |
| 38 | fabric thickness |
| 39 | gap width |
| 40 | section of 10' where it is processed in 22 |
| 41 | supporting beam for 20, mounting rail |
| 42 | guide projection for 21 |
| 43 | electric cable |
| 44 | electric components |
| 45 | electric printed-circuit board for 44 |
| 46 | channel in 35 |
| 47 | function indicators on 35 |
| 48 | lower shaped strip of 41 |
| 49 | upper shaped strip of 41 |
| 50 | housing |
| 51 | first side plate of 50 |
| 52 | second side plate of 50 |
| 53 | space between 51 and 52 |
| 54 | insert for 59 |
| 55 | hole in 35 |
| 56 | additional piece in 53 |
| 57 | open space in 35 |
| 58 | angled notch in 51, 52 for 48 |
| 59 | catch spring on 50 for 49 |
| 60 | means for adjusting 50 along 41 |
| 61 | toothed rack on 41 |
| 62 | pinion of 60 |
| 63 | shaft of 62 |
| 64 | upper bearing in 54 for 63 |
| 65 | arrow of pivoting motion of 50 (FIG. 2) |
| 66 | longitudinal adjustment of 50 (FIG. 3) |
| 67 | lower bearing in 56 for 63 |
| 68 | operating end of 63 |
| 69 | operating arrow of 63 |

-continued

| List of Reference Numbers | |
|---|---|
| 70 | first deflecting point, crest area of 26, deflecting surface |
| 71 | second deflecting point, support zone of 36 |
| 72 | third deflecting point, additional support zone of 36 |
| 73 | insert in 74 of 23', cushion |
| 74 | recess in 23' (FIG. 5) |
| 75 | flexible deflecting surface of 73, outside surface of cushion (FIG. 5) |
| 76 | contact surface of 23", 23"', in 30" (FIG. 7) |
| 77 | coating on 23", 33" (FIG. 7) |
| 78 | elevated rear step surface of 33' (FIG. 8) |
| 79 | forward step surface of 33' (FIG. 8) |
| 80 | tape profile, transverse cross section of tape |
| 81 | cushion shape of 73 |

What is claimed is:

1. Device for separating a fusible wide web, preferably a woven (10) or knitted fabric made of fusible thread material (11, 14) into at least two tapes (10'), especially tapes of patterned labels, with at least one fusion cutter (21) at the desired separation point (24) in the wide web (10), to cut the web as it moves longitudinally (27) by melting through the web material to form two adjacent tapes (10');

with a finishing device (22), which acts on the edge areas of the cut tapes (10') to smooth the rough, fused edges (29);

and finally with a transport device (28), which moves the wide web (10) and the tapes (10') into which it has been cut in the longitudinal direction (27), and which holds at least the section (40) of the tapes (10') to be processed under a longitudinal tension, in the area of the finishing device (22), wherein the finishing device (22) consists of several deflecting points (70, 71, 72), which act on the edge areas of the tapes (10') in the section (40) to be processed;

where the deflecting points (70, 71, 72) are offset with respect to each other both in the direction of the longitudinal movement (27) of the tape (10') and also in the vertical direction and cause the straight-through course of the known section (40) to be processed to proceed at an angle;

and in that the longitudinal tension automatically pulls the edge areas of the tapes (10') in the section (40) to be processed against the deflecting points (70, 71, 72).

2. Device according to claim 1, wherein the deflecting points (70, 71, 72) consist of deflecting elements (23, 33), which enclose between them an open gap (25), through which gap (25) the section (40) to be processed passes without being clamped.

3. Device according to claim 1, wherein the deflecting elements (23, 33) are mounted in an essentially stationary manner and are designed to be dimensionally stable.

4. Device according to claim 1, wherein at least one of the deflecting elements (23') has an elastically flexible outside surface (75) for contact with the tapes (10').

5. Device according to claim 4, wherein the deflecting element (23", 33") has a flexible coating (77) on the surface (76) which comes in contact with the tapes (10').

6. Device according to claim 4, wherein the deflecting element (23') has an insert designed as an elastic cushion (73), and in that the external surface (75) of the cushion is in contact with the tapes (10').

7. Device according to claim 4, where the tapes, because of their variable thickness (38, 38'), have different longitudinal profiles in the transport direction and/or different transverse profiles (80) perpendicular to the transport direction, wherein the elastically flexible circumferential surface (75) of the deflecting element (23') adjusts itself automatically (81) to the profile of the tapes.

8. Device according to claim 1, wherein the deflecting points (70, 71, 72) consist only of an upper and a lower deflecting element (23, 33), and in that the deflecting elements (23, 33) have two gap surfaces (26, 36), which produce a gap (25) between them, one of these gap surfaces (36) being concave, the other (26) convex.

9. Device according to claim 1, wherein although the deflecting elements (23, 33) are not heated, they are so close to the fusion cutter (21) that the edge areas (29) of the tapes (10') are still plastic when the reach the deflecting surfaces.

10. Device according to claim 8, wherein the fusion cutter consists of a heated wire (21), one end of which is attached to the upper deflecting element (23), the other end to the lower deflecting element (33).

11. Device according to claim 1, wherein the two deflecting elements (23, 33) are at the same time conductors which supply the heating current to the fusion cutter (21).

12. Device according to claim 1, wherein the fusion cutter (21) and the deflecting elements (22, 23) form a preassembled, compact assembly (30), and in that this assembly (30) can be mounted at the point (24) where it is desired to cut the wide web (10).

13. Device according to claim 12, wherein the assembly (30) is a component of a block (35), where the block (35) is mounted on a supporting beam (41) which extends crosswise over the wide web (10) and can be shifted along the supporting beam (66) to adjust the desired width of the tapes (10') to be cut.

14. Device according to claim 13, wherein at least some electrical components (44), which serve to control the heating of the fusion cutter (21), are integrated into the associated block (35).

15. Device according to claim 13, wherein function indicators (47) for the thermal and/or mechanical operating state of the associated fusion cutter (21) are integrated into the block (35).

16. Device according to claim 13, wherein the block (35) has the form of a plate and is a component of a housing (50), consisting of two side plates (51, 52) a certain distance apart;

the block (35) consists of insulating material and is mounted in the space (53) between the two side plates (51, 52) of the housing (50);

the block (35) has electrical connections for the fusion cutter (21) and possibly contains the electrical components (44) required to control the heating of the fusion cutter (21); and the housing (50) carries the latching means (58, 59) for attaching the block (35) to the beam (41) and possibly the adjusting means (60) for the longitudinal adjustment (66) of the block (35) along the supporting beam (41).

17. Device according to claim 16, wherein the latching means (59) and possibly the adjusting means (60) are installed in the space (53) between the two side plates (51, 52) of the housing (50).

18. Device according to claim 1, wherein the assembly (30) or the block (35) with the assembly (30) are integrated into the loom on which the wide web (10) is produced.

19. Device according to claim 1, wherein the assembly (30) or the block (35) with the assembly (30) is a component of a cutting table, which allows the wide web (10) produced elsewhere to be cut later into individual tapes (10').

* * * * *